US005943998A

United States Patent [19]

Brown et al.

[11] Patent Number: 5,943,998

[45] Date of Patent: Aug. 31, 1999

[54] MAGNETIC FUEL ENHANCER

[75] Inventors: Ed Brown, Cambridge; Adam Resch, Kitchener, both of Canada

[73] Assignee: 1184949 Ontario Inc.

[21] Appl. No.: 09/021,468

[22] Filed: Feb. 10, 1998

[51] Int. Cl.[6] ..... F02M 27/04

[52] U.S. Cl. ..... 123/538

[58] Field of Search ..... 123/538, 536, 123/537; 210/222, 695

[56] References Cited

U.S. PATENT DOCUMENTS

| | | | |
|---|---|---|---|
| 3,349,354 | 10/1967 | Miyata . | |
| 4,808,306 | 2/1989 | Mitchell et al. | 123/538 |
| 5,076,246 | 12/1991 | Onyszczuk . | |
| 5,124,045 | 6/1992 | Janczak et al. | 123/538 |
| 5,129,382 | 7/1992 | Stamps . | |
| 5,161,512 | 11/1992 | Adam . | |
| 5,320,751 | 6/1994 | Burns | 123/538 |
| 5,329,911 | 7/1994 | Jeong . | |
| 5,500,121 | 3/1996 | Thornton et al. . | |
| 5,536,401 | 7/1996 | Burns . | |
| 5,637,226 | 6/1997 | Adam et al. | 123/536 |
| 5,716,520 | 2/1998 | Mason | 123/538 |

*Primary Examiner*—Marguerite McMahon
*Attorney, Agent, or Firm*—Dimock Stratton Clarizio; Mark B. Eisen

[57] ABSTRACT

The invention provides a magnetic fuel enhancement device in which a series of magnets is disposed about the periphery of an activation chamber, and a fuel conduit passes through a magnetic field region defined between the magnets. In the preferred embodiment the fuel conduit passes through the device many times, repeatedly exposing the fuel to magnetic fields within the device and thus increasing the amount of energy imparted to the fuel before combustion, and a concentrating rod attracts the magnetic fields toward the center of the chamber to focus the magnetic fields through the fuel conduit.

16 Claims, 2 Drawing Sheets

MAGNETIC FUEL ENHANCER

FIELD OF THE INVENTION

This invention relates to fuel pre-combustion treatment devices. In particular, this invention relates to a magnetic fuel enhancer for fluid hydrocarbon fuels such as gasoline, which improves combustion efficiency by exposing the fuel to magnetic fields which energize the molecules in the fuel prior to combustion.

BACKGROUND OF THE INVENTION

Hydrocarbon fuel combustion is one of the most widely used energy sources in the world. The environmental hazards associated with with hydrocarbon fuel combustion emissions are well known, and accordingly many treatment methods have been developed to reduce harmful pollutants produced during the combustion of hydrocarbons.

For example, fuel additives have been formulated for the pre-combustion treatment of specific fuels. However, such additives are consumable and must therefore be added on a regular basis. The production of fuel additives consumes finite resources and itself contributes to environmental problems. Further, each type of fuel requires its own specially formulated additive, which must be combined with the fuel in precise proportions and is therefore not well suited for consumer use.

Post-combustion treatment devices such as catalytic converters and flue gas scrubbers have also been developed to reduce harmful combustion emissions. However, these types of devices are fuel-specific and must be properly installed and maintained in order to have a practical life span, which is in any event limited. Flue gas scrubbers also require special additives and constant control of operating parameters. Moreover, such post-combustion treatment devices do not address the efficiency of fuel combustion, and therefore do not aid in preserving non-renewable fuel resources.

Magnetic fields are known to be useful for the pre-combustion treatment of fluid fuels flowing through a conduit. In the case of fluid hydrocarbon fuels such as gasoline and propane, treatment by magnetic fields improves combustion efficiency by energizing the fuel molecules, which results in more complete combustion of the fuel in a combustion chamber (which may for example be the cylinder of an automobile engine) downstream of the device, and reduces both the rate of fuel consumption and the production of environmentally harmful combustion emissions.

Accordingly, pre-combustion treatment devices have been developed which enhance the combustibility of fuel such as gasoline by exposing the fuel to one or more magnetic fields as it passes through a fuel conduit upstream of the combustion device. Such devices have a virtually unlimited life span, require little or no maintenance or adjustment and are easily retrofitted to existing combustion systems.

In order to maximize the efficiency of such a system it is desirable to concentrate magnetic fields in the vicinity of the fuel conduit. Prior art systems such as that described in U.S. Pat. No. 5,329,911 issued Jul. 19, 1994 to Jeong, which is incorporated herein by reference, provide a fuel conduit adjacent to a magnetic body which produce magnetic fields that radiate outwardly and thus energize the fuel as it flows through the conduit. Jeong provides a magnetic induction layer which surrounds both the magnetic body and the conduit, to induce magnetic forces around the fuel activation duct.

This system provides certain disadvantages. The size of the magnetic body is necessarily limited by confining the magnetic body within a magnetic induction layer, if the device is to be maintained within practical size limits, and the strength of the magnetic field to which the fuel is exposed is thus commensurately limited. Since the fuel conduit passes adjacent to the magnetic body only once, the degree of energization achieved during pre-combustion treatment is limited. Also, providing a metal induction layer that surrounds the magnet and the fuel conduit significantly increases the weight of the device, which can be a disadvantage particularly in automotive applications.

The present invention overcomes these problems by providing a magnetic fuel enhancement device having a series of magnets disposed about the periphery of an activation chamber and a fuel conduit extending through a magnetic field region defined between the magnets. In the preferred embodiment a metal concentrating rod extends generally centrally through the magnetic field region, attracting the magnetic fields toward the center of the chamber and thereby focusing the magnetic fields through the fuel conduit and maximizing the amount of magnetic flux which is perpendicular to the direction of fuel flow, to optimize enhancement of the fuel. Also, in the preferred embodiment the fuel conduit passes through the activation chamber many times, repeatedly exposing the fuel to magnetic fields and thus increasing the amount of energy imparted to the fuel before combustion. The invention accordingly improves fuel energization while maintaining the size and weight of the fuel enhancer within practical limits.

The present invention thus provides a fuel enhancer for the pre-combustion treatment of a fluid hydrocarbon fuel, comprising a housing, a plurality of magnets disposed within the housing in spaced apart relation and in like polar orientation, a magnetic field region being defined between the magnets, and a fuel conduit extending through the magnetic field region having a fuel inlet and a fuel outlet, whereby fuel flowing through the fuel conduit is exposed to magnetic fields within the magnetic field region and is thereby energized before egressing through the fuel outlet.

The present invention further provides a fuel enhancer for the pre-combustion treatment of a fluid hydrocarbon fuel, comprising a housing, a plurality of magnets disposed within the housing in spaced apart relation and in like polar orientation, a magnetic field region being defined between the magnets, and a fuel conduit extending through the magnetic field region having a fuel inlet and a fuel outlet, wherein the fuel conduit comprises a plurality of runs, each run passing through the magnetic field region such that fuel flowing through the fuel conduit is repeatedly exposed to magnetic fields within the magnetic field region and is thereby energized before egressing through the fuel outlet.

The present invention further provides, in combination, a hydrocarbon fuel combustion device and a fuel enhancer for the pre-combustion treatment of a fluid hydrocarbon fuel, the fuel enhancer comprising a housing, a plurality of magnets disposed within the housing in spaced apart relation and in like polar orientation, a magnetic field region being defined between the magnets, and a fuel conduit extending through the magnetic field region having a fuel inlet and a fuel outlet, whereby fuel flowing through the fuel conduit is exposed to magnetic fields within the magnetic field region and is thereby energized before egressing through the fuel outlet.

In the preferred embodiments a magnetic concentrating member extends axially across the magnetic field region, attracting magnetic fields produced by the magnets and focusing them through the fuel conduit.

BRIEF DESCRIPTION OF THE DRAWINGS

In drawings which illustrate by way of example only a preferred embodiment of the invention.

DETAILED DESCRIPTION OF THE INVENTION

Figure 1:
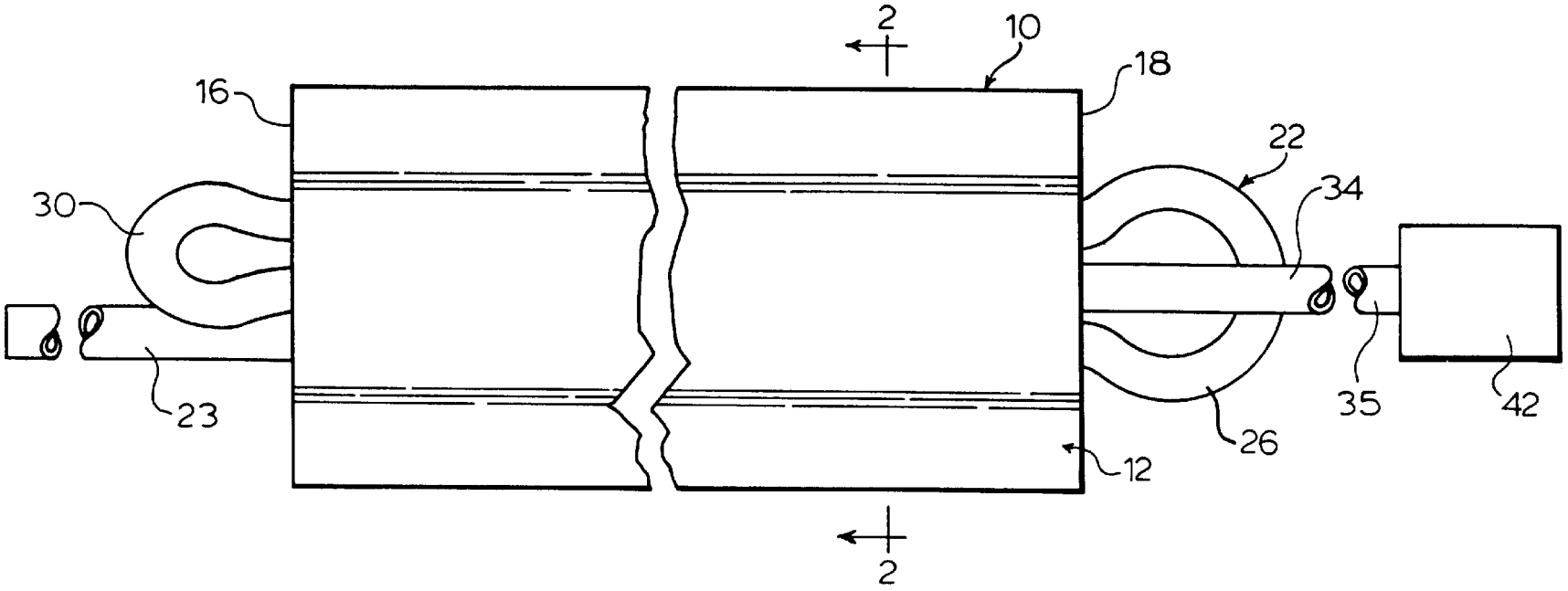
FIG. 1 is a side elevation of the device of FIG. 1.
Figure 2:
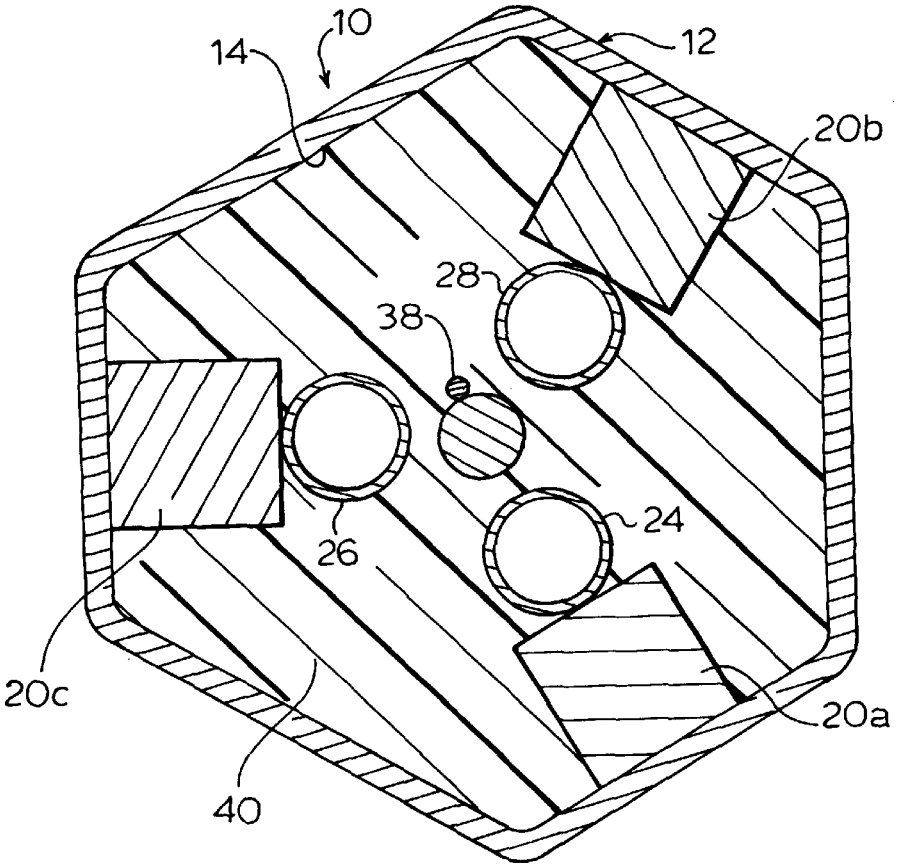
FIG. 2 is a cross-sectional side elevation of a fuel enhancement device embodying the invention.
Figure 3:
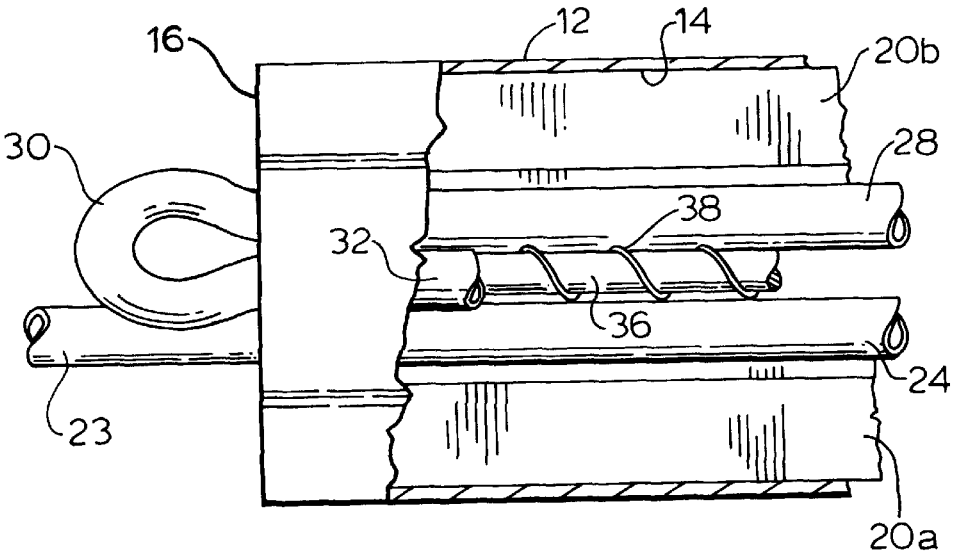
FIG. 3 is a partially cutaway side elevation of the device of FIG. 1.

Referring to FIGS. 1 to 3, the fuel enhancer 10 comprises a housing 12 which is preferably composed of a magnetic material such as soft steel. A plurality of magnets 20, preferably three permanent magnets 20*a*, 20*b* and 20*c* as in the embodiment shown, are disposed about the interior of the housing 12 in spaced apart relation, preferably symmetrically and substantially adjacent to the inner wall 14 of the housing 12. The magnets 20 may be electromagnets, but permanent magnets 20 are preferred because no separate power source is required to generate the magnetic fields.

The magnets 20 are preferably oriented with their north poles directed outwardly, preferably in contact with the housing inner wall 14, so that the south poles of the magnets 20 are oriented inwardly to direct positive energy through a magnetic field region defined between the magnets 20. The housing 12 is thus preferably formed in an irregular hexagonal shape, facilitating even spacing of the magnets 20 and allowing complete contact between the north poles of the magnets 20 and the inner wall 14 of the housing 12. The housing 12 comprises ends 16, 18 composed of a like magnetic material, so that the housing 12 fully encloses the device and confines the negative energy produced by the system, thereby channelling more positive energy toward the fuel. The housing 12 also serves to protect the device against extraneous electromotive fields such as those produced by electric motors and other ambient electrical fields.

The inlet 23 of a fuel conduit 22 made of a material suitable for the intended fuel enters the housing 12 through the upstream end 16 and is coupled to a first run 24 disposed adjacent to (preferably in contact with) the south pole of a first magnet 20*a*. The first run 24 exits the housing 12 through the downstream end 18 and loops back into the downstream end 18 of the housing 12 through return loop 26 to a second run 28 disposed adjacent to the south pole of a second magnet 20*b*. The second run 28 exits the housing 12 through the upstream end 16 and loops back into the upstream end 16 of the housing 12 through return loop 30 to a third run 32 disposed adjacent to the south pole of a third magnet 20*c*. The third run 32 exits the housing through the downstream end 18 at outlet 34 and is coupled to a conduit 35 which conveys the energized fuel to the combustion device 42 (shown schematically in FIG. 1).

Within the housing 12 the three runs 24, 28 and 32 are preferably parallel, so that each run 24, 28, 32 is exposed to magnetic fields relatively uniformly along its length, and for maximum fuel activation the magnets 20 preferably extend substantially along the entire axial length of the housing 12. Also, for optimal enhancement the direction of fuel flow should be perpendicular to the lines of magnetic flux generated by the magnets 20. The return loops 26, 30, 34 should be as small as possible to avoid loss of fuel energization, but sharp bends should be avoided so as not to create unnecessary turbulence within the flowing fuel.

The diameter of the device 10 is preferably as small as possible, to maximize the strength of the magnetic fields within the magnetic field region, but is limited only by the strength of the selected magnets 20 (it being preferable that the magnetic fields overlap in the magnetic field region). The length of the device is limited by constraints inherent in the intended use, for example in retrofit applications of the device 10.

To further enhance the pre-combustion energization of the fuel, a concentrating member 36 is provided preferably coaxially with the housing 12. The concentrating member 36 is a solid rod or bar formed from a ferrous substance such as iron, and serves to attract the magnetic fields produced by the magnets 20 toward the axial center of the housing 12, concentrating the magnetic fields in the magnetic field region to maximize the magnetic flux energizing the fuel. The concentrating rod 36 further serves to maximize the amount of magnetic flux which is perpendicular to the direction of fuel flow. The concentrating rod 36 is welded or otherwise suitably affixed to the ends 16, 18 of the housing 12. In the preferred embodiment an electrically conductive wire 38, preferably formed from a ferrous material, is wound around the concentrating rod 36 in a helical fashion and attached to the housing 12 by a screw or weld, to bond the housing 12 and the concentrating member 36 and thereby re-energize photons in the magnetic field region.

The entire contents of the housing 12 are preferably encased in a rugged, durable thermoplastic compound 40. The plastic filler 40 reinforces the housing 12, protects the components of the device 10 from damage and maintains all of the components in their proper physical relationship.

In operation, the fuel enhancer 10 is installed in a fuel combustion system between the fuel source (not shown) and the combustion device 42, for example the engine of an automobile, either by the manufacturer or as a retrofit device in an existing combustion system. The inlet 23 is coupled to the fuel supply and the outlet 34 is coupled to the combustion device 42. The fuel enhancer 10 is preferably installed close to the combustion device 42, to minimize loss of fuel activation as the energized fuel is conveyed along the conduit 35.

As the combustion device 42 is activated and begins to draw fuel, fuel from the fuel source enters the housing 12 through the inlet 23 and is energized by the first magnet 20*a* as it is conveyed through the first run 24. The fuel exits and reenters the device 10 through loop 26 and is further energized by the second magnet 20*b* as it is conveyed through the second run 28. The fuel exits and reenters the device 10 again through loop 30 and is further energized by the third magnet 20*c* as it is conveyed through the third run 32. The energized fuel egresses from the device through outlet 34, from which it is conveyed to the combustion device 42 along conduit 35. The concentrating member 36 attracts the magnetic fields produced by the magnets 20, focusing positive energy toward the center of the magnetic field region and thus concentrating the magnetic fields in the region of the fuel conduit runs 24, 28, 32.

The invention having been thus described by way of example only, it will be apparent to those skilled in the art that certain modifications and adaptations may be made without departing from the scope of invention. For example, without limiting the foregoing, providing more or fewer magnets 20 and/or fuel conduit runs may be suitable for any particular application. The invention is intended to include all such modifications and adaptations as fall within the scope of the appended claims.

We claim:

1. A fuel enhancer for the pre-combustion treatment of a fluid hydrocarbon fuel, comprising a housing, a plurality of magnets disposed within the housing in spaced apart relation and in like polar orientation, a magnetic field region being defined between the magnets, a fuel conduit extending through the magnetic field region having a fuel inlet and a fuel outlet, and a magnetic concentrating member comprising a metallic rod or bar extending axially across the magnetic field region, to attract magnetic fields produced by the magnets, whereby fuel flowing through the fuel conduit is exposed to magnetic fields within the magnetic field region and is thereby energized before egressing through the fuel outlet.

2. The fuel enhancer of claim 1 in which three magnets are disposed in substantially evenly spaced relation about the periphery of the magnetic field region.

3. The fuel enhancer of claim 1 including a conductive wire in contact with the concentrating member and bonded to the housing.

4. The fuel enhancer of claim 3 in which the conductive wire is wound around the concentrating member in a helical pattern.

5. The fuel enhancer of claim 1 in which the concentrating member extends substantially coaxially with the housing.

6. The fuel enhancer of claim 1 in which the fuel conduit passes through the magnetic field region a plurality of times.

7. The fuel enhancer of claim 1 in which the housing is filled with a thermoplastic compound.

8. A fuel enhancer for the pre-combustion treatment of a fluid hydrocarbon fuel, comprising a housing, a plurality of magnets disposed within the housing in spaced apart relation and in like polar orientation, a magnetic field region being defined between the magnets, a fuel conduit extending through the magnetic field region having a fuel inlet and a fuel outlet, and a magnetic concentrating member comprising a metallic rod or bar extending axially across the magnetic field region, to attract magnetic fields produced by the magnets, wherein the fuel conduit comprises a plurality of runs, each run passing through the magnetic field region such that fuel flowing through the fuel conduit is repeatedly exposed to magnetic fields within the magnetic field region and is thereby energized before egressing through the fuel outlet.

9. The fuel enhancer of claim 8 in which three magnets are disposed in substantially evenly spaced relation about the periphery of the magnetic field region.

10. The fuel enhancer of claim 8 in which a conductive wire in contact with the concentrating member is bonded to the housing.

11. The fuel enhancer of claim 8 in which the fuel conduit passes through the magnetic field region three times.

12. In combination, a hydrocarbon fuel combustion device and a fuel enhancer for the pre-combustion treatment of a fluid hydrocarbon fuel, the fuel enhancer comprising a housing, a plurality of magnets disposed within the housing in spaced apart relation and in like polar orientation, a magnetic field region being defined between the magnets, a fuel conduit extending through the magnetic field region having a fuel inlet and a fuel outlet, and a magnetic concentrating member comprising a metallic rod or bar extending axially across the magnetic field region, to attract magnetic fields produced by the magnets, whereby fuel flowing through the fuel conduit is exposed to magnetic fields within the magnetic field region and is thereby energized before egressing through the fuel outlet.

13. The combination of claim 12 in which three magnets are disposed in substantially evenly spaced relation about the periphery of the magnetic field region.

14. The combination of claim 12 in which a conductive wire in contact with the concentrating member is bonded to the housing.

15. The combination of claim 12 in which the fuel conduit passes through the magnetic field region three times.

16. The combination of claim 12 in which the combustion device is an automobile engine.

* * * * *